US006253934B1

(12) United States Patent
Schroeder et al.

(10) Patent No.: US 6,253,934 B1
(45) Date of Patent: Jul. 3, 2001

(54) STACKING AND COVER ARRANGEMENT FOR POWDER SPRAY CONTROLLERS

(75) Inventors: Joseph G. Schroeder, North Royalton; Merle C. Lehman, Avon Lake; Robert J. Allsop, South Amherst, all of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/579,851

(22) Filed: May 25, 2000

(51) Int. Cl.[7] ..... A47F 5/00

(52) U.S. Cl. ..... 211/194; 211/189; 312/265.3; 312/265.6

(58) Field of Search ..... 211/189, 194, 211/26; 312/265.1, 265.2, 265.3, 265.4, 265.5, 265.6; 361/829, 826

(56) References Cited

U.S. PATENT DOCUMENTS

| | | | | |
|---|---|---|---|---|
| 3,404,931 | * | 10/1968 | Fall et al. . | |
| 5,536,079 | * | 7/1996 | Kostic | 212/265.3 |
| 5,800,615 | * | 9/1998 | Lambert et al. | 118/326 |
| 5,806,945 | * | 9/1998 | Anderson et al. | 312/265.3 |
| 5,832,073 | * | 11/1998 | Hannigan et al. | 361/826 X |
| 5,889,648 | * | 3/1999 | Heavirland et al. | 211/194 X |
| 6,036,290 | * | 3/2000 | Jancsek et al. | 212/265.4 |
| 6,071,558 | * | 6/2000 | Shutic | 427/180 |
| 6,129,946 | * | 10/2000 | Adams | 427/8 |

OTHER PUBLICATIONS

Manual No. 33–5 for "100 Plus® Master Control Unit," Nordson Corporation, Amherst, Ohio ©1991.

Versa–Spray® II Automatic Spray System product literature, Nordson Corporation, Amherst, Ohio ©1997.

Gema Automatic Powder System product literature, Gema, Indianapolis, IN ©1994.

ITW Gema Automatic Powder Unit product literature, ITW Gema, Indianapolis, IN ©1994 Gema.

Wagner–Reclaim Powder Application and Recovery Systems product literature, Wagner Systems, Glendale Heights, Illinois ©1995 Wagner Systems Inc.

* cited by examiner

*Primary Examiner*—Robert W. Gibson, Jr.
(74) *Attorney, Agent, or Firm*—Nenad Pejic; Calfee, Halter & Griswold LLP

(57) ABSTRACT

A stacking arrangement for at least two controllers in a powder spray system provides for the controllers to be vertically stacked one on top of the other, and an interlock mechanism between each pair of adjacently stacked controllers. In a preferred embodiment, the interlock mechanism comprises a tab and slot arrangement between each pair of adjacent top and bottom covers of stacked controllers. The tab and slot securely hold the stacked controllers together in a stable vertically aligned configuration. Locking plates are also provided to releasably secure the controllers together. The invention also provides a vertically adjustable cover mechanism for the stacked controllers. The cover mechanism encloses various lines that are connected to the controllers in the final assembly. The cover mechanism includes a vertically fixed cover part and an adjustable cover part that telescopically slides over the fixed cover part. The adjustable cover permits controllers to be added to or removed from the spray apparatus by vertically stacking the controllers, without having to acquire a custom length cover each time the vertical height is changed.

21 Claims, 4 Drawing Sheets

STACKING AND COVER ARRANGEMENT FOR POWDER SPRAY CONTROLLERS

FIELD OF THE INVENTION

The present invention relates to powder spraying apparatuses. More particularly, the invention relates to stacking arrangements for powder spray controllers and adjustable covers therefor.

BACKGROUND OF THE INVENTION

Electrostatic spray systems apply powder paints and coatings to a variety of products including, for example, appliances, automotive components, metal office furniture/storage shelving, electrical transformers, and recreational equipment. A critical component of such spray systems is a spray gun and a spray gun controller. The spray gun and the spray gun controller are responsible for generating a corona-charging effect that is the basis of electrostatic spray systems.

In corona-charging systems, the power supply charges the gun electrode to a high voltage which produces an electric field between the spray gun and a part to be painted. Powder is sprayed through the area of the electric field. Passing through this area, the powder particles are charged and are drawn to the usually grounded part to be painted. In this manner, the part to be painted is coated with powder paint.

In a typical powder spray system, the various spray gun controllers are mounted in racks within an overall enclosure. Although such an arrangement is acceptable in many applications, it is not particularly space efficient. Moreover, electronic controllers are by design able to control the operations of a large number of guns in more complex spraying systems. A master controller can now be used in combination with a substantial number of spray controllers, but a conventional rack design simply takes too much space and makes repairs more time consuming. The various tubes and wires may be routed in rather convoluted and lengthy runs making maintenance and operation somewhat cumbersome.

It is therefore an objective of the present invention to provide improved powder spray systems that incorporate a number of powder spray controllers and a master controller into a single, smaller and compact support unit. Preferably, the support unit should include expansion capability as a system is expanded.

SUMMARY OF THE INVENTION

To the accomplishment of the foregoing objectives, and in accordance with one embodiment of the invention, a stacking arrangement for at least two controllers in a powder spray system provides for the controllers to be vertically stacked one on top of the other, and an interlock mechanism between each pair of adjacently stacked controllers. In a preferred embodiment, the interlock mechanism comprises a tab and slot arrangement between each pair of adjacent top and bottom covers of stacked controllers. The tab and slot securely hold the stacked controllers together in a stable vertically aligned configuration. Locking plates are also provided to releasably secure the controllers together.

In accordance with another aspect of the invention, a vertically adjustable cover mechanism is provided for the stacked controllers. The cover mechanism encloses various lines that are connected to the controllers in the final assembly. The cover mechanism includes a vertically fixed cover part and an adjustable cover part that in one embodiment telescopically slides over the fixed cover part. The adjustable cover permits controllers to be added to or removed from the spray apparatus by vertically stacking the controllers, without having to acquire a custom length cover each time the vertical height is changed.

These and other aspects and advantages of the present invention will be apparent to those skilled in the art from the following description of the preferred embodiments in view of the accompanying drawings.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to example the principles of this invention.

DETAILED DESCRIPTION OF ILLUSTRATED EMBODIMENT

Figure 2:
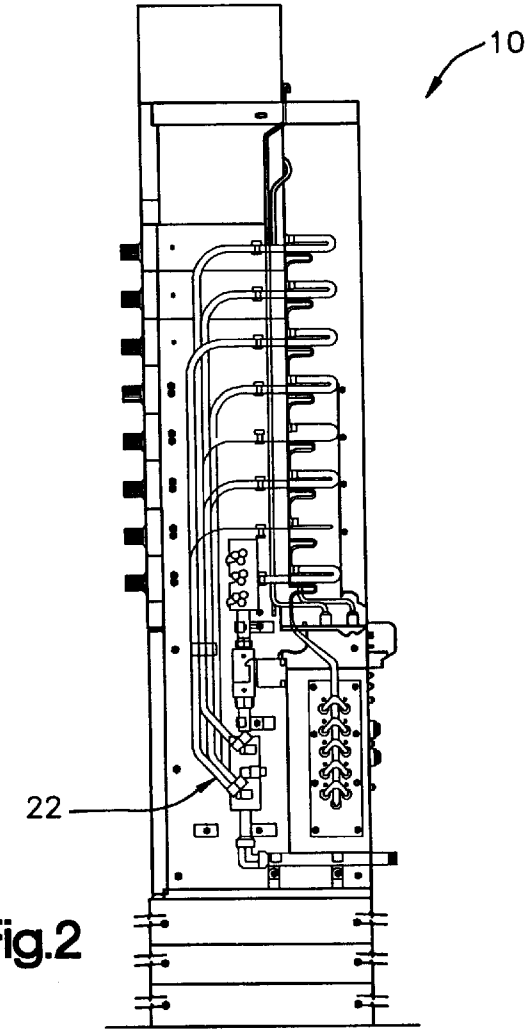
FIG. 2 is a side elevation of the arrangement of FIG. 1.
Figure 1:
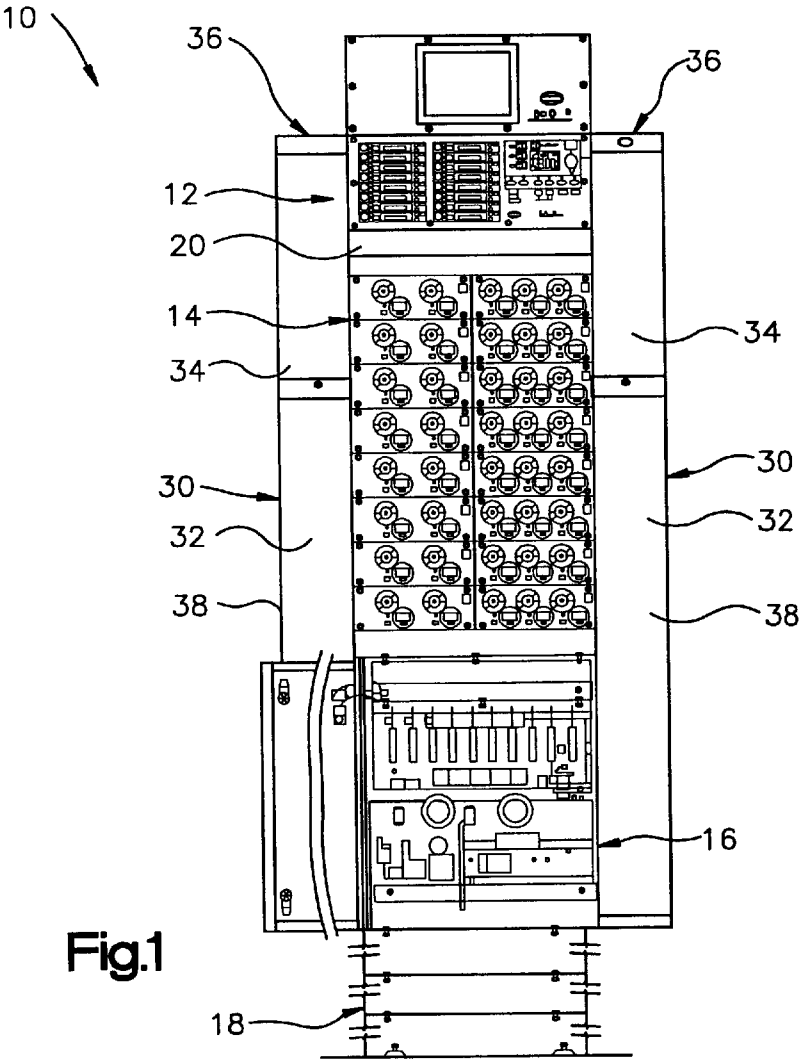
FIG. 1 is a front elevation of a stacking arrangement for powder spray controllers in accordance with the invention.

With reference to FIGS. 1 and 2, a control system for a powder spray apparatus is generally indicated with the numeral 10. The control system 10 may include a main or master controller 12 and a plurality of pneumatic controllers 14. The pneumatic controllers 14 are vertically stacked one on top of the other as illustrated above a power cabinet 16. The pneumatic controllers 14 are shown as two types: first type along the left side of the stack and a second type along the right side of the stack. The first type of pneumatic controller includes two gauges for reading air flows (i.e., two different flow air path readings and one atomizing air flow path reading) to pumps. The second type of pneumatic controller includes three gauges for reading air flows (i.e., two different flow air path readings and one atomizing air flow path reading.) In the preferred embodiment, only one type of controller would be used in both the left and right sides of the stack. This is because most pneumatic systems provide either one or two flow air paths, but not both. The entire assembly 10 may rest on a number of bases 18. The master controller 12 is preferably though not necessarily stacked on top of the pneumatic controllers 14 with a spacer 20 therebetween.

With the controllers stacked one on top of the other, various lines 22 are routed along the side of the apparatus 10. These lines may include powder and pneumatic tubing, and wiring. In addition, pneumatic controls, filters and other system 10 components may be mounted along the side of the assembly. In order to protect the lines 22 and other components along the sides of the assembly 10, a cover mechanism 30 is provided. In the illustrated embodiment, a cover mechanism 30 is used on each side of the controller assembly 10, although in some applications only one may be required. Also, the basic concepts of the cover mechanism 30 could be easily applied as a back cover or even a front cover if so required for a specific application.

Each cover mechanism 30 includes a lower fixed cover 32 and an upper vertically adjustable cover 34. The fixed cover 32 has a vertical height that is determined generally by the vertical height of the power cabinet and the additional height of the initial number of stacked pneumatic controllers 14. The adjustable cover 34 is releasably attached at its lower end to an upper end of the fixed cover 32. The adjustable cover 34 telescopically slides over the outer perimeter of the fixed cover 32. In this manner, as more controllers 14 are stacked on top of the assembly 10, the adjustable cover 34 can be raised in height. This avoids the need for special covers for each height configuration of the assembly 10. Conversely, if controllers 14 are removed, the adjustable cover 34 can be lowered to adjust its vertical height accordingly.

A top cover 36 is provided that fits over the top end of the adjustable cover 34. A flat side cover panel 38 is provided over the fixed side cover 32. All of the covers 32, 34, 36 and 38 are preferably made of sheet metal that is lightweight and easy to form. Note that in FIG. 2 the flat side panel is not shown, and the extendible cover is partly removed to illustrate the lines 22.

Figure 3B:
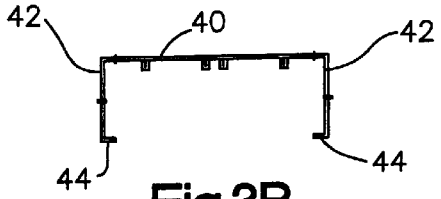
FIGS. 3A, 3B and 3C are front, top and side views of a fixed cover used with the arrangement of FIG. 1.
Figure 3C:
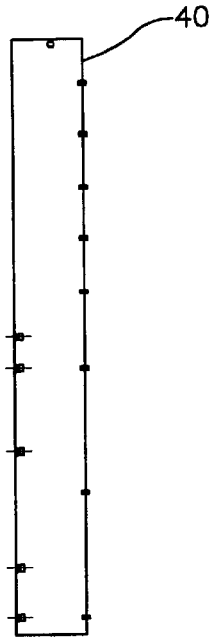
Figure 3A:
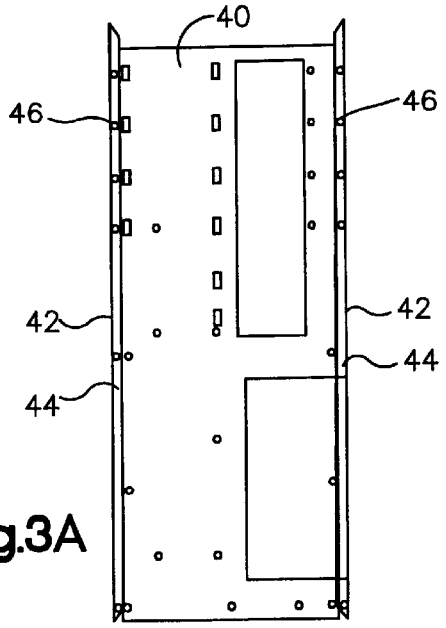

With reference to FIGS. 3A–3C, the fixed cover 32 is a U-shaped frame that has a main wall 40 that is attached by screws to the controller 14 enclosures and to the power cabinet 16. Two vertical legs 42 extend transversely from the wall 40 and include inward flanges 44 that extend generally parallel with the main wall 40. The flanges 44 include a number of vertically oriented holes 46. Sheet metal screws (not shown) are used to secure the flat side cover 38 to the fixed cover 32 at the hole 46 locations.

Figure 4B:
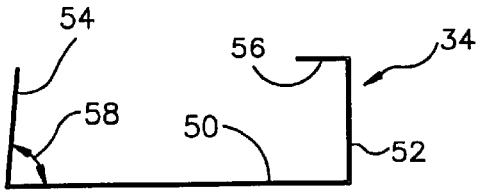
FIGS. 4A–4C are front, top and side views of an adjustable cover used with the arrangement of FIG. 1.
Figure 4A:
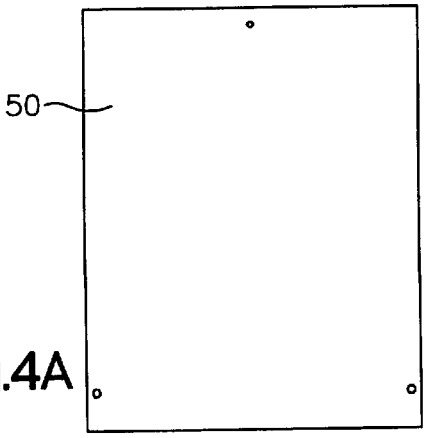
Figure 4C:
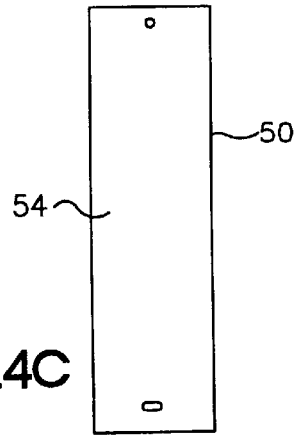

With reference to FIGS. 4A–4C, the adjustable cover 34 is also a generally U-shaped frame having a main wall 50 and a first side wall 52 that extends transversely from the main wall 50. The transverse side wall 52 includes an inward flange 56 that extends generally parallel to the main wall 50. This flange 56 fits behind the back wall 40 of the fixed cover 32. The adjustable cover 34 also includes a second side wall 54. The second side wall 54 is bent inward at an angle 58, rather than being generally transverse like the other side wall 56. The angle may be, for example, about 85°. By having the side wall 54 bent slightly inward, the side wall 54 has a spring like property to it that allows the side wall 54 to snugly engage the side wall 42 of the fixed cover 32. The engagement can be made snug enough so that the adjustable cover 34 is vertically supported by friction during assembly. After the height of the adjustable cover 34 has been set, the cover can be attached to the fixed cover 32 as by sheet metal screws, for example (not shown). The top cover 36 which may be in the form of a cap, can then be installed.

In this manner, the cover assembly 30 can be used to protect the lines 22 and other side mounted components on the assembly 10, and can be adjusted in height as the occasion arises based on the number and height of stacked controllers 14.

Figure 5A:
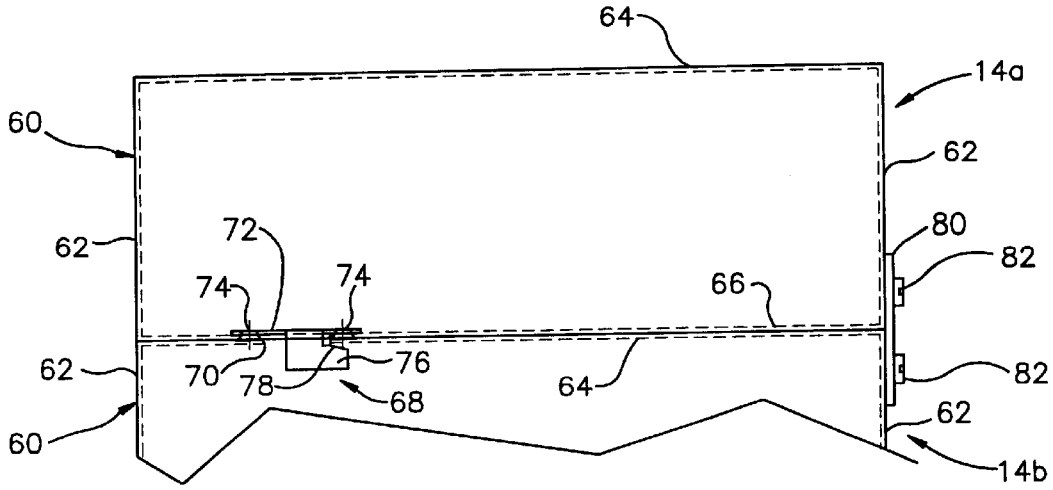
FIG. 5A is a side view in section and FIGS. 5B and 5C are partial top views of alternative embodiments of a pair of stacked controllers of the assembly in FIG. 1.

With reference to FIGS. 1 and 5A, 5B and 5C, the pneumatic controllers 14 are vertically stacked one on top of the other as illustrated. In order to minimize the vertical spacing, as well as to provide a stable assembly, an interlock mechanism is provided between each pair of adjacently stacked controllers 14. FIG. 5A illustrates one such pair **14*a* and 14*b*. There may be, of course, another controller 14 stacked above the upper controller in FIG. 5A, and/or another controller below the lower controller of FIG. 5A**.

Figure 5B:
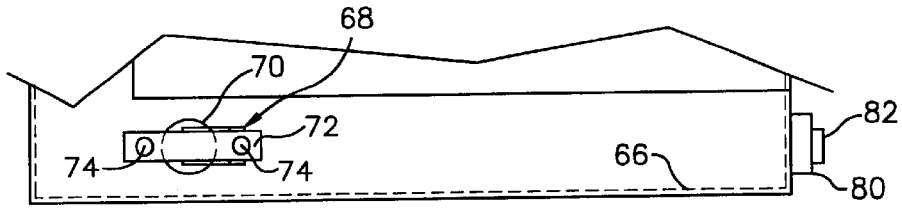
Figure 5C:
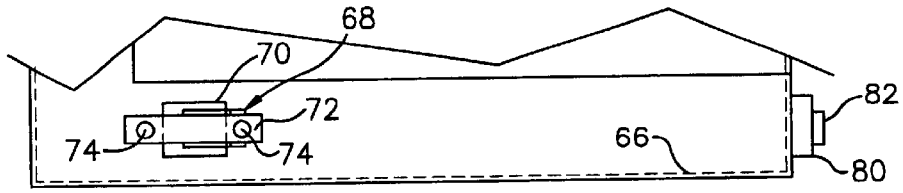

Each controller 14 includes an enclosure 60 having four side walls 62, a top wall 64 and a bottom wall 66. Each bottom wall 66 includes a downwardly extending tab 68 and each top wall 64 has a corresponding hole or slot 70. FIG. 5B shows hole 70 while FIG. 5C shows slot 70. The tab 68 extends from a mounting flange 72 that is fixedly attached to the bottom wall 66 by screws 74. The tab is appropriately sized to extend down through the hole 70 into the interior of the bottom enclosure of the lower controller **14*b*. The tab 68 includes a lip 76 that forms a recess 78. The recess 78 slideably receives an edge of the hole 70 to interlock the controllers 14*a* and 14*b* together. A single tab and slot arrangement can be used or multiple tab and slot arrangements can be used for each pair of adjacently stacked controllers 14. As shown in FIGS. 5D and 5E**, preferably two such interlocking devices are used in the illustrated embodiment.

More specifically, FIG. 5D shows a top view and FIG. 5E shows a bottom view of controller **14*b*. Referring now to FIG. 5D in particular, top wall 64 is shown having two holes 70 generally located on the periphery of wall 64 and opposite each other. FIG. 5E shows bottom wall 66 having two tabs 68 also located on the periphery of wall 66 and opposite each other. As discussed the tabs 68 and whole 70 are specifically located on the controller so as to provide an interlocking connection with another or subsequent controller that is to be stacked on or below the present controller. The specific location of the tabs 68 and holes 70 on walls 64 and 66 can be varied—so long as they provide the aforementioned interlocking connection. For example, the tabs 68 and holes 70 may be generally forward, midway, or rear located on walls 64 and 66. Furthermore, they may be located more central to the walls 64 and 66** as opposed to the periphery thereof.

Referring now back to FIGS. 5A–5C, once the controllers **14*a* and 14*b* are interlocked, a restraining strap 80 may be used to secure the controllers together. The strap 80 is attached to each controller enclosure 60 as by screws 82. In the preferred embodiment, two restraining straps 80 are employed on opposite ends of the rear side walls 62. The restraining straps 80 are preferably made of a metal plates. In alternative embodiments, restraining straps 80 may be incorporated into the lower portions of rear side walls 62 such that they partially extend therefrom and co-locate with screw holes in upper portions of the next interlocking controller. In this manner, the location and operation of the restraining strap 80 is similar to that shown in FIG. 5A, but the restraining strap 80** is integral to the controller.

Figure 6A:
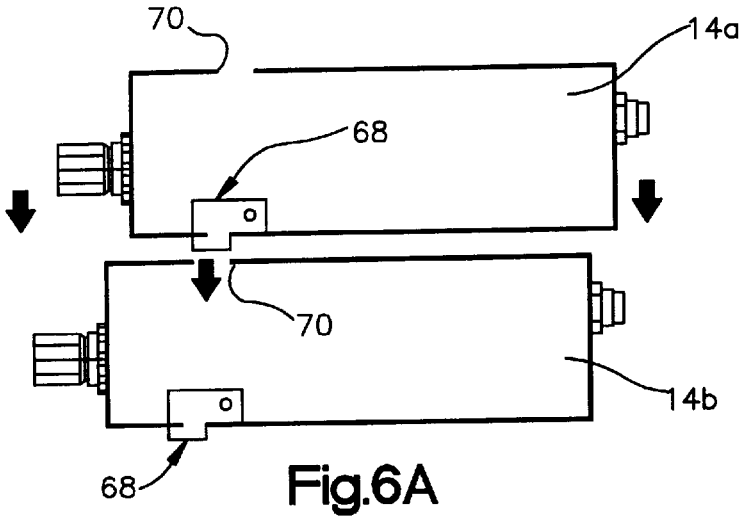
FIGS. 6A–6C illustrate in elevation a typical assembly procedure for the stacked controllers and interlock mechanism of FIGS. 5A, 5B, and 5C.
Figure 6B:
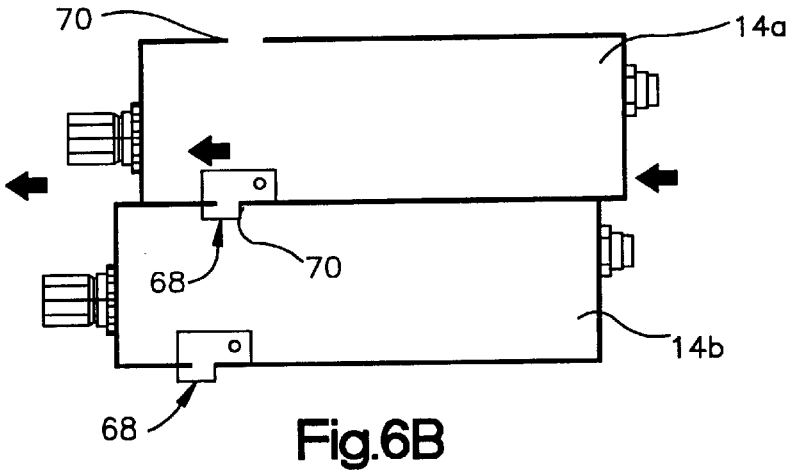
Figure 6C:
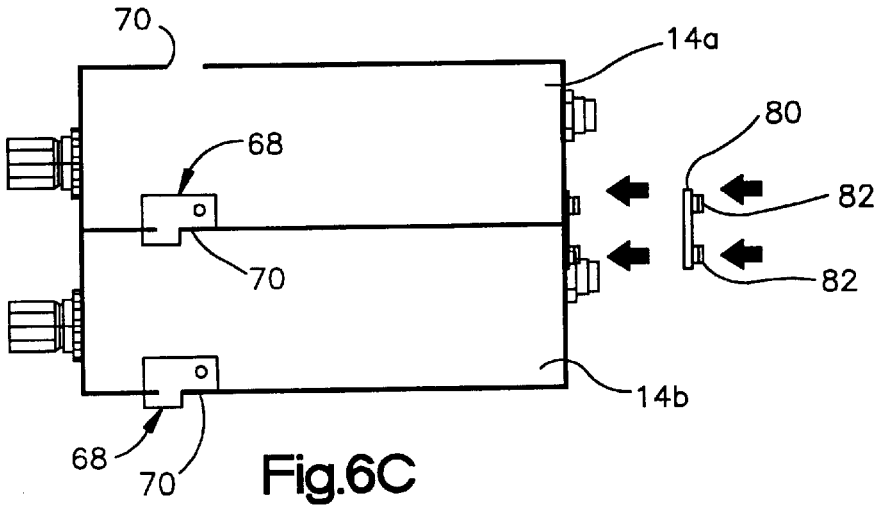

FIGS. 6A–6C illustrate a typical assembly procedure. The upper controller **14*a* is positioned over the lower controller 14*b* so that the tabs 68 align with the holes 70 (FIG. 6A). The upper controller 14*a* is then stacked on top of the lower controller 14*b* so that the tabs 68 are inserted into the corresponding holes 70 (FIG. 6B). Next the upper controller 14*a* is slid over the lower controller 14*b* (to the left as viewed in FIGS. 6A–6C) so that the lip 76 engages the top wall 64 of the lower controller 14*b* with the wall edge of the hole 70 slipping into the recess 78. Finally, the retaining strap 80** is installed.

The retaining strap 80 is optional, as there may be other mechanisms provided to prevent the controllers 14 from sliding relative to each other after the final assembly. Various tongue and groove alternatives could be used for the tab and slot arrangement to provide a camming action as the two controllers are slid into alignment, for example.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

We claim:

1. A stacking assembly for powder spray controllers in a powder spray system, comprising:

at least two controllers with each controller having an enclosure comprising a top cover and a bottom cover;

the controllers being stacked one on top of the other;

and an interlock mechanism between a bottom cover and adjacent top cover of each pair of adjacently stacked controllers;

said interlock mechanism securely holding said stacked controllers together when the system is assembled.

2. The assembly of claim 1 wherein said interlock mechanism comprises a tab and a slot that align and connect said adjacently stacked controllers together; said tab being on a bottom cover of one of said controllers and said slot being on a top cover of a subjacent controller.

3. The assembly of claim 2 wherein said tab inserts into said slot and connects said stacked controllers together; said tab including a tongue that slides under and against said top cover when said stacked controllers are stacked and vertically aligned on four sides by a sliding movement of the top controller over the bottom controller.

4. The assembly of claim 2 wherein said interlock mechanism further comprises a connector plate releasably attached to each of said stacked controllers with said stacked controllers in an aligned and interlocked position.

5. The assembly of claim 1 comprising at least four controllers stacked one on top of the other, and a interlock mechanism between each pair of adjacently stacked controllers.

6. The assembly of claim 1 comprising an adjustable cover for said controllers, said adjustable cover enclosing lines connected to said controllers along at least one side thereof.

7. The assembly of claim 6 wherein said adjustable cover comprises a first cover part that is fixed in vertical height and attached to said controllers, and a second cover part that is adjustable in vertical height.

8. The assembly of claim 7 wherein said second cover part is attachable to said first cover part with a selected vertical height to cover lines connected to said controllers.

9. The assembly of claim 8 wherein said second cover part telescopically slides over said first cover part to adjust vertical height of said second cover part.

10. The assembly of claim 9 comprising a top cover installed after said second cover part is secured to said first cover part.

11. A stacking assembly for powder spray controllers in a powder spray system, comprising:

at least two controllers stacked one on top of the other;

and an adjustable cover for said controllers, said adjustable cover enclosing lines connected to said controllers along at least one side thereof.

12. The assembly of claim 11 wherein said adjustable cover comprises a first cover part that is fixed in vertical height and attached to said controllers, and a second cover part that is adjustable in vertical height.

13. The assembly of claim 12 wherein said second cover part is attachable to said first cover part with a selected vertical height to cover lines connected to said controllers.

14. The assembly of claim 13 wherein said second cover part telescopically slides over said first cover part to adjust vertical height of said second cover part.

15. The assembly of claim 14 comprising a top cover installed after said second cover part is secured to said first cover part.

16. The assembly of claim 11 wherein each controller has an enclosure comprising a top cover and a bottom cover; and an interlock mechanism between a bottom cover and adjacent top cover of each pair of adjacently stacked controllers; said interlock mechanism securely holding said stacked controllers together when the system is assembled.

17. The assembly of claim 16 wherein said interlock mechanism comprises a tab and a slot that align and connect said adjacently stacked controllers together; said tab being on a bottom cover of one of said controllers and said slot being on a top cover of a subjacent controller.

18. The assembly of claim 17 wherein said tab inserts into said slot and connects said stacked controllers together; said tab including a tongue that slides under and against said top cover when said stacked controllers are stacked and vertically aligned on four sides by a sliding movement of the top controller over the bottom controller.

19. The assembly of claim 17 wherein said interlock mechanism further comprises a connector plate releasably attached to each of said stacked controllers with said stacked controllers in an aligned and interlocked position.

20. The assembly of claim 16 comprising at least four controllers stacked one on top of the other, and a interlock mechanism between each pair of adjacently stacked controllers.

21. The assembly of claim 1 wherein said interlock mechanism comprises a tab and a slot that align and connect said adjacently stacked controllers together; said tab being on a top cover of one of said controllers and said slot being on a bottom cover of a subjacent controller.

* * * * *